US008347892B2

(12) United States Patent
Mehio

(10) Patent No.: US 8,347,892 B2
(45) Date of Patent: Jan. 8, 2013

(54) DISPOSABLE HOOKAH BOWL

(75) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 0 days.

(21) Appl. No.: 12/815,204

(22) Filed: Jun. 14, 2010

(65) Prior Publication Data

US 2010/0242973 A1 Sep. 30, 2010

Related U.S. Application Data

(63) Continuation of application No. 11/384,806, filed on Mar. 20, 2006, now abandoned.

(51) Int. Cl.
*A24D 1/14* (2006.01)

(52) U.S. Cl. ..... 131/348; 131/173

(58) Field of Classification Search ..... 131/348, 131/173
See application file for complete search history.

(56) References Cited

U.S. PATENT DOCUMENTS

| | | | | |
|---|---|---|---|---|
| 4,944,317 | A * | 7/1990 | Thal | 131/348 |
| 2006/0086365 | A1* | 4/2006 | Liu | 131/173 |
| 2006/0207621 | A1* | 9/2006 | Shraiber | 131/348 |

* cited by examiner

*Primary Examiner* — Richard Crispino
*Assistant Examiner* — Dionne Walls Mayes
(74) *Attorney, Agent, or Firm* — Da Vinci's Notebook, LLC

(57) ABSTRACT

The present invention is directed to a disposable hookah bowl and hookah bowl product that are moisture-sealed. The hookah bowl includes a tobacco compartment, an ignitable product shelf, a heat inlet seal, and a particulate outlet seal. The hookah bowl product includes the hookah bowl and a combustible product, such as massell.

20 Claims, 6 Drawing Sheets

DISPOSABLE HOOKAH BOWL

RELATED APPLICATIONS

This application is a continuation of, and claims priority under 35 U.S.C. §120 from, U.S. patent application Ser. No. 11/384,806, filed Mar. 20, 2006, now abandoned, the disclosure of which is incorporated herein by reference.

FIELD OF THE INVENTION

The present invention relates to the field of smoking implements and more specifically to the field of hookah components.

BACKGROUND

Of the many proud traditions of Ottoman culture, few have achieved the world-wide fame of hookah smoking Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a base, a pipe, at least one hose with a mouthpiece, and a bowl. The hookah bowl holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah pipe is the body of a hookah and is usually fabricated from brass, tin, or stainless steel. The pipe transports the massell smoke from the bowl to the hookah base, which is a cavern containing water. The base of the hookah is typically fabricated of glass or plastic and tends to be the most expressive portion of the hookah, ranging from translucent to wildly-colored. Within the cavern of the hookah base, the massell smoke is cooled by the water within. The cooled massell smoke then returns to the back to the pipe, though not through the same entrance by which the massell smoke enters the base. From the pipe, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the pipe and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

As hookah use increases in prominence, the need to make hookah smoking more amenable to a larger market increases in importance. Hookah preparation, measured in either time or work, is simply not comparable to cigar, cigarette, or pipe preparation. Presently a hookah must often be completely assembled from its base components, any tobacco product placed within a hookah must be manually placed within the bowl, water must be placed within the hookah, and the hookah must be checked for air leaks before a user begins to smoke from the hookah. Therefore there is a need for innovation that minimizes hookah preparation time and work.

SUMMARY

The present invention is directed to a disposable hookah bowl and hookah bowl product. The hookah bowl includes a tobacco compartment, an ignitable product shelf, a heat inlet seal, and a particulate outlet seal.

The tobacco compartment includes a heat inlet, a particulate outlet, and the ignitable product shelf. The ignitable product shelf is a support within the tobacco compartment upon which a tobacco product rests. The heat inlet allows the downward passage of heat into the tobacco compartment to ignite any product upon the ignitable product shelf. The ignitable product shelf includes a particulate passage for allowing smoke generated from tobacco ignition to travel down into the particulate outlet. The particulate outlet is the portion of the tobacco compartment that allows the passage of particulates from the hookah bowl into a hookah pipe or similar object.

In order to retain moisture within the tobacco compartment, the heat inlet and particulate outlet are sealed with a heat inlet seal and a particulate outlet seal, respectively. The preferred heat inlet seal is an adhesive patch which can positioned to shield the heat inlet from an exterior environment and prevent substantial diminishment of the inherent moisture within hookah tobacco. The preferred particulate outlet seal is an adhesive patch oriented to shield the tobacco compartment by blocking the particulate outlet.

The hookah bowl product includes the hookah bowl with hookah tobacco disposed within the tobacco compartment.

Therefore, it is an aspect of the present invention to introduce a hookah bowl requiring minimal preparation time.

It is a further aspect of the present invention to introduce a hookah bowl that retains moisture.

It is a still further aspect of the present invention to introduce a hookah bowl capable of disposable use It is a still further aspect of the present invention to introduce a hookah bowl product that includes hookah-amenable tobacco that possesses a relatively long shelf life.

These aspects of the invention are not meant to be exclusive. Additionally, some aspects may apply to particular versions or embodiments, but not other versions or embodiments. Other features, aspects, and advantages of the present invention will be readily apparent to those of ordinary skill in the art when read in conjunction with the following description, and accompanying drawings.

DETAILED DESCRIPTION

Figure 1:
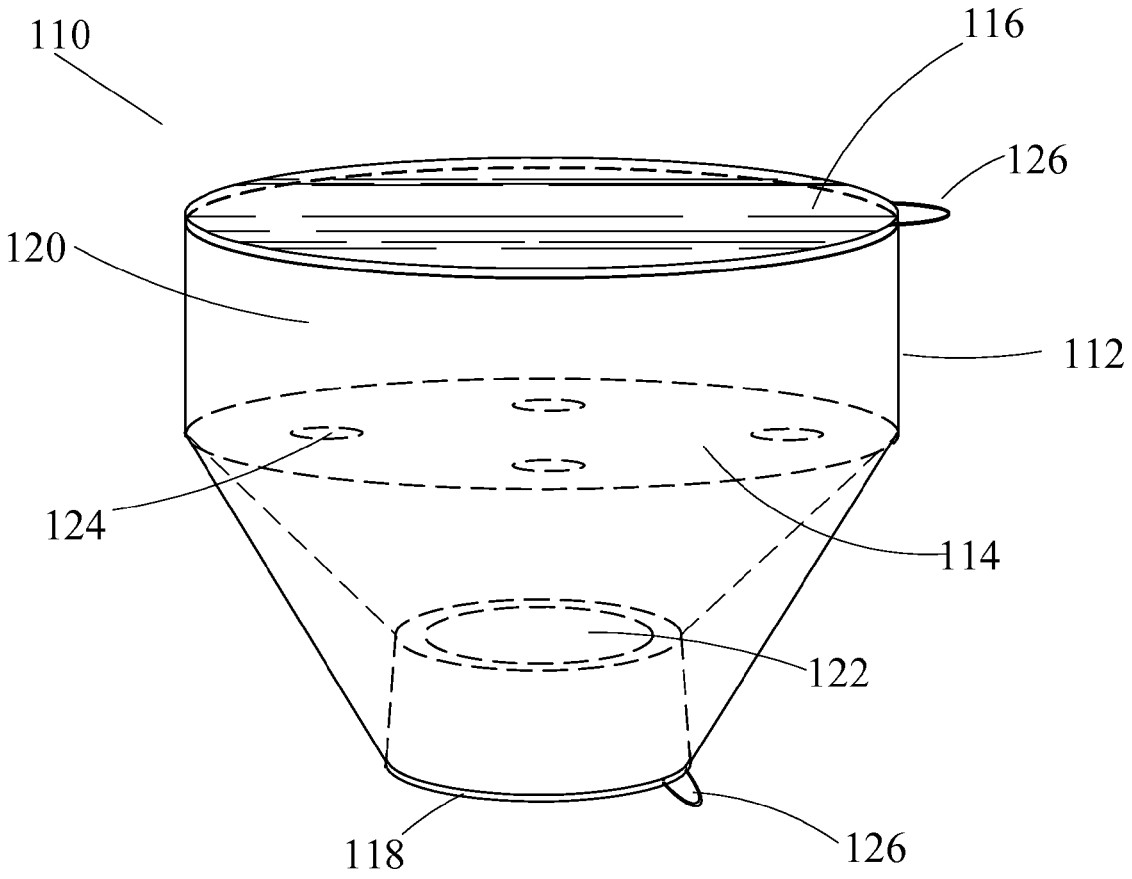
FIG. 1 is a perspective view of an embodiment of the hookah bowl, showing the interior thereof.

Referring first to FIG. 1, an embodiment of the disposable hookah bowl is shown. The hookah bowl includes a tobacco compartment 112, an ignitable product shelf 114, a heat inlet seal 116, and a particulate outlet seal 118.

The tobacco compartment 112 is the container of the hookah bowl and includes a heat inlet 120, a particulate outlet 122 (in the Egyptian style), and the ignitable product shelf 114. The tobacco compartment is manufactured of a self-supporting, durable material that is resistant to both moisture and heat. The hookah bowl tobacco compartments may be manufactured of any of the following materials: clay, metal, pyrex, plastic, ceramic, and acrylic. In a preferred embodiment of the present invention, the tobacco compartment is manufactured of a substantially translucent material, e.g. pyrex.

The ignitable product shelf 114 is tray in the interior of the tobacco compartment 112 that is dimensioned to support an ignitable product. Preferred ignitable products contemplated for use in the present invention include tobacco combined with moisture-bearing additives, e.g. massell. However, simply because the present invention was designed with the massell containment in mind does not limit the hookah bowl to massell. The tobacco compartment is not limited to any particular type of tobacco, tobacco derivative, or smokable product; rather, any smokable product capable of use within the tobacco compartment will suffice.

The ignitable product shelf 114 includes a particulate passage 124. The particulate passage may include one or more holes within the ignitable product shelf 114. The purpose of the particulate passage is to allow fluid communication from the heat inlet 120 and the particulate outlet 122. The heat inlet 120 is the portion of the tobacco compartment 112 that allows a downward passage of heat into the tobacco compartment 112, which ignites any product upon the ignitable product shelf 114. The particulate outlet 122 includes one or more holes in the bottom of the tobacco compartment that allows the passage of particulates from the hookah bowl into a hookah pipe or similar object.

The heat inlet seal 116 and the particulate outlet seal 118 are obstructions that block moisture egress. The seals substantially retard the flow of gases between the interior gases of the tobacco container and the exterior gases of whatever environment the hookah bowl 110 finds itself. In preventing this environmental equilibrium, the seal should be composed of a material substantially impervious to moisture passage, if not gaseous passage. These qualities need to be present for a reasonable shelf-life time. There are many devices and structures having varied compositions that will fulfill the purpose of the seal of the present invention. Because sealing devices are too numerous to discuss within this disclosure, this description will focus on preferred sealing devices.

Figure 2:
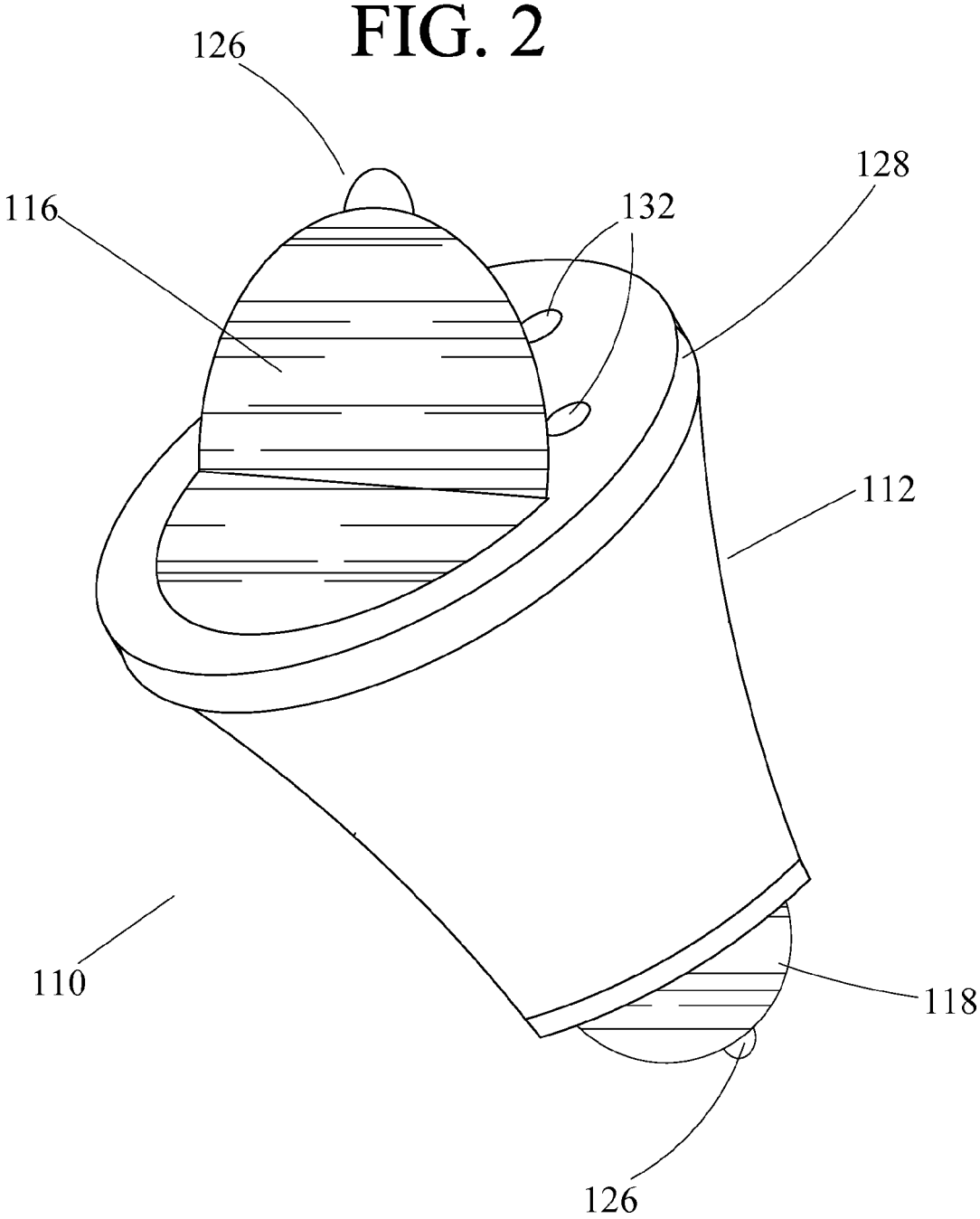
FIG. 2 is a perspective view of an embodiment of the hookah bowl illustrating the removal of a heat inlet seal.

FIG. 1 shows the preferred seal for the heat inlet seal 116 and the particulate outlet seal 118, an adhesive patch covering both the heat inlet 120 and particulate outlet 122 respectively. The adhesive patch can be at the least, a simple sticker made of a moisture containment material. When an adhesive patch is used, it is preferred that there exist structure to assist a user in removing the adhesive patch. Patch tabs 126 that abut the perimeter of the seal serve such a purpose admirably. The patch tab 126 is a seal protrusion that does not include an adhesive material. As FIG. 2 illustrates, the lack of adhesive allows a user to easily manipulate the patch tab 126, which allows the user to more easily dislocate the adhesive patch 116. The preferred adhesive patch is made of a weatherproof vinyl.

FIG. 2 further illustrates an embodiment of the hookah bowl 110 that includes a combustion platform 128. The combustion platform 128 is a platform having a combustion passage 132 of one or more holes that lead into the heat inlet. The combustion platform 132 allows a user to place a combustible material thereon rather than labor through conventional methods for generating heat in the hookah bowl, e.g. using perforated foil to support coals. The preferred combustion platform is manufactured of a self-supporting, durable material that is resistant to both moisture and heat. The shape and configuration of the combustion platform 128 can be any that allows the combustion platform to fulfill its purpose: support coal and separate the coal from any tobacco product upon the ignitable product tray. The preferred material of the combustion tray is a hard plastic. In embodiments with a combustion platform 128 and an adhesive patch 116, the adhesive patch 116 is preferably positioned on the portion of the combustion platform proximate to the outside environment.

Figure 3:
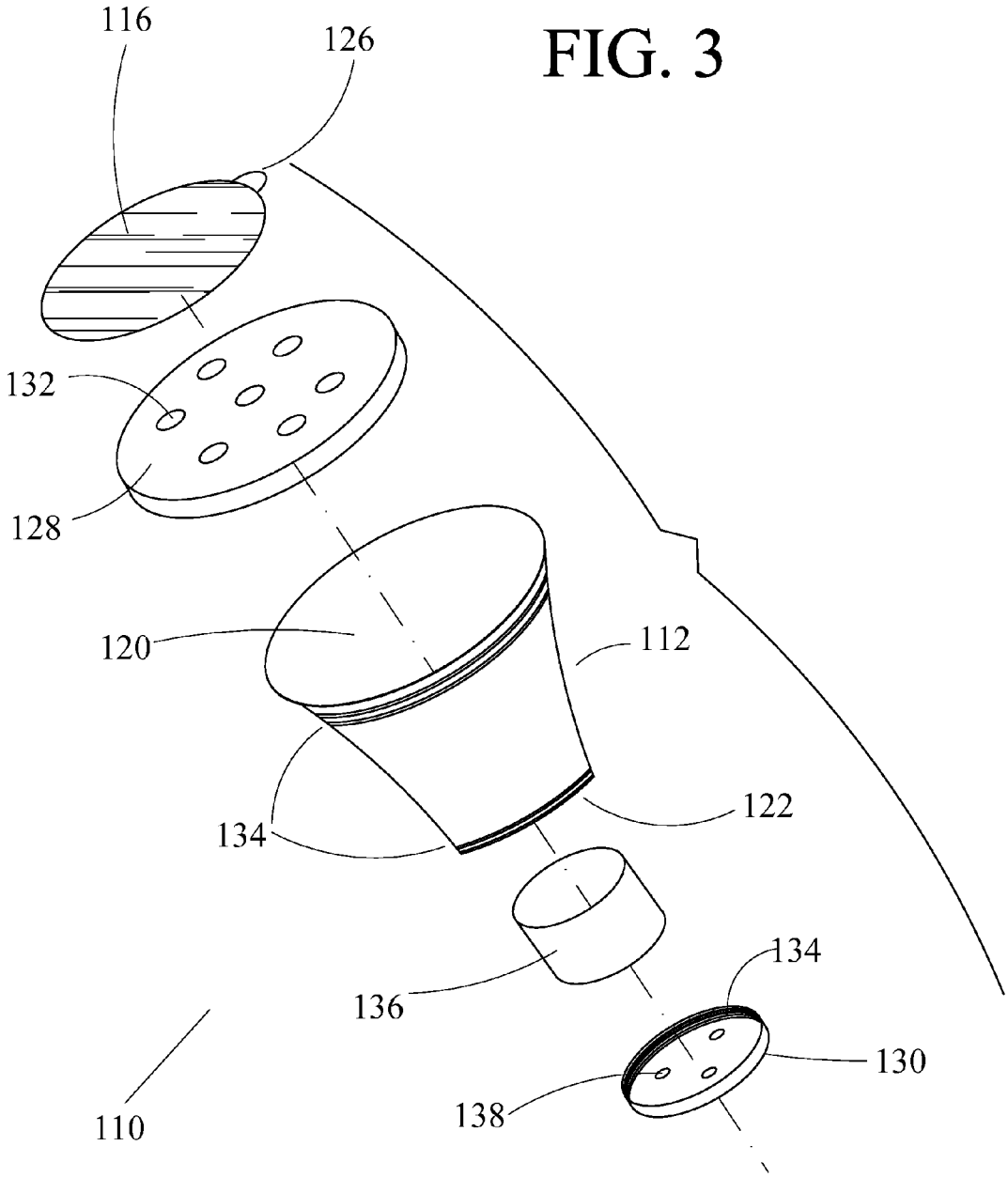
FIG. 3 is an exploded, perspective view of an embodiment of the hookah bowl.

Although the combustion cap 128 can be form-fitted onto the tobacco compartment 112, as FIG. 3 shows, the present invention can additionally includes threading 134 on the combustion cap 128 (threading not shown) and the tobacco container 112. In the embodiment pictured, the threading 134 is on the exterior of the tobacco compartment 112 and the interior of the combustion cap 128; however, embodiments having combustion caps 128 with exterior threading and tobacco compartments 112 with interior threading may be preferred.

The hookah bowl embodiment 110 of FIG. 3 further includes an elastic impediment 136 that frictionally engages the particulate outlet 122. As this hookah bowl embodiment 110 illustrates, sealing devices need not be always included on exterior portions of the hookah bowl 110. The elastic impediment 136 is a device used to seal the particulate outlet 122 against moisture egress. Unlike the adhesive patch, the elastic impediment uses friction to block moisture; the elastic impediment 136 is made of a collapsible material that adjusts to the interior structure of the particulate outlet 122. Upon use, a user need only remove the elastic impediment 136 from the particulate outlet 122.

The hookah bowl embodiment of FIG. 3 further illustrates the outlet cap 130 of the present invention. The outlet cap 130 at least partially covers the particulate outlet 122 and allows a hookah bowl 110 to stand freely on a surface. Although versions of the outlet cap 130 include outlet cap holes 138 to allow the passage of smoke, other versions of the outlet cap may not have holes and thereby serve as a seal. Although an outlet cap 130 can be size-fitted onto the tobacco compartment 112, an additionally joining means includes threading 134 on both the outlet cap 130 and the tobacco compartment 112.

Figure 4:
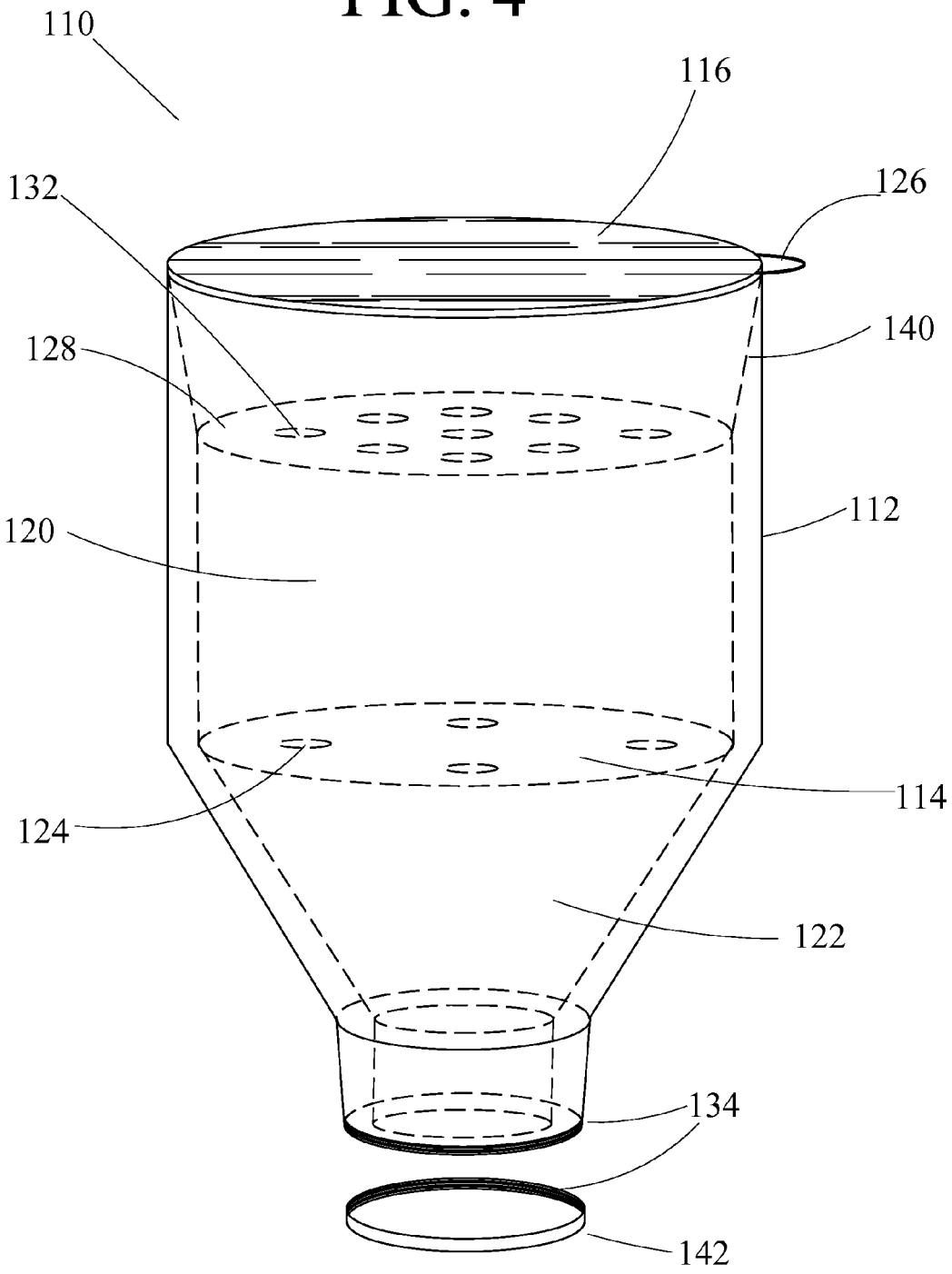
FIG. 4 is a perspective view of an embodiment of the hookah bowl, showing the interior thereof.

FIG. 4 illustrates a Lebanese style hookah bowl embodiment 110 that includes a combustion cap 128 having a containment ridge 140 about its perimeter. A purpose of the combustion cap is to allow a user to place charcoal thereon; the containment ridge 140 is a protrusion that prevents the large portions of combustion material from falling from the combustion cap 128. An additional benefit of the containment ridge is that it shields combustion material from the wind drafts at angles substantially parallel to the upper surface of the combustion cap 128.

Of further note in FIG.4 is the cap seal 142, which shares structural similarities to the outlet cap 130 of FIG. 3. The cap seal 142 of FIG. 4 differs from the outlet cap of FIG. 3 in that the cap seal 142 of FIG. 4 does not include any holes through which air and moisture may escape the tobacco compartment 112. The cap seal 142 screws onto to tobacco compartment 134. Although the cap seal 142 of FIG. 4 is shown engaging the particulate outlet 122 of the hookah bowl, the cap seal 142 could also be dimensioned to engage the tobacco compartment 112 in a manner that obstructs the heat inlet 120.

Figure 5A:
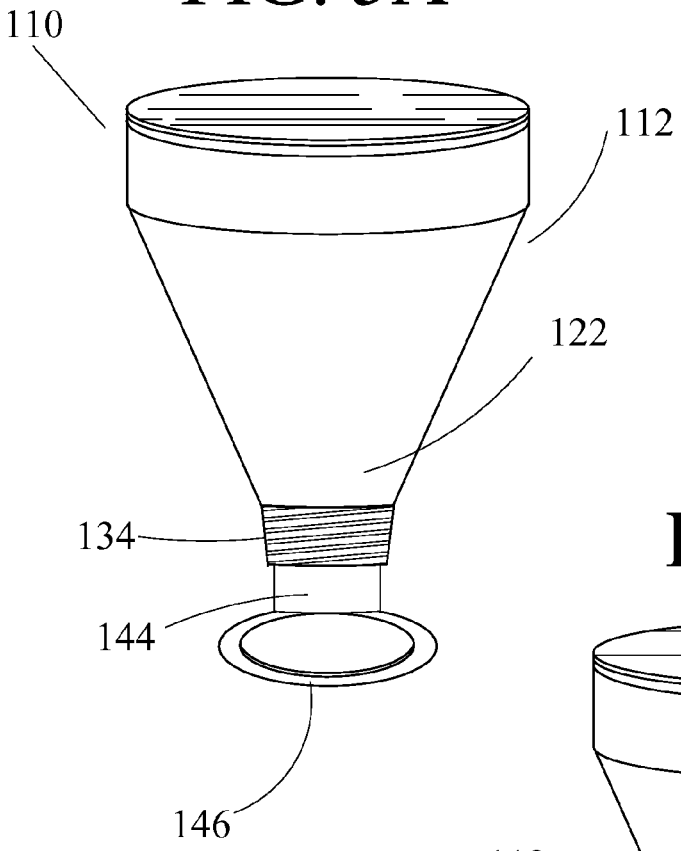
FIGS. 5A and 5B are perspective views of the hookah bowl highlighting the use of a plug seal.
Figure 5B:
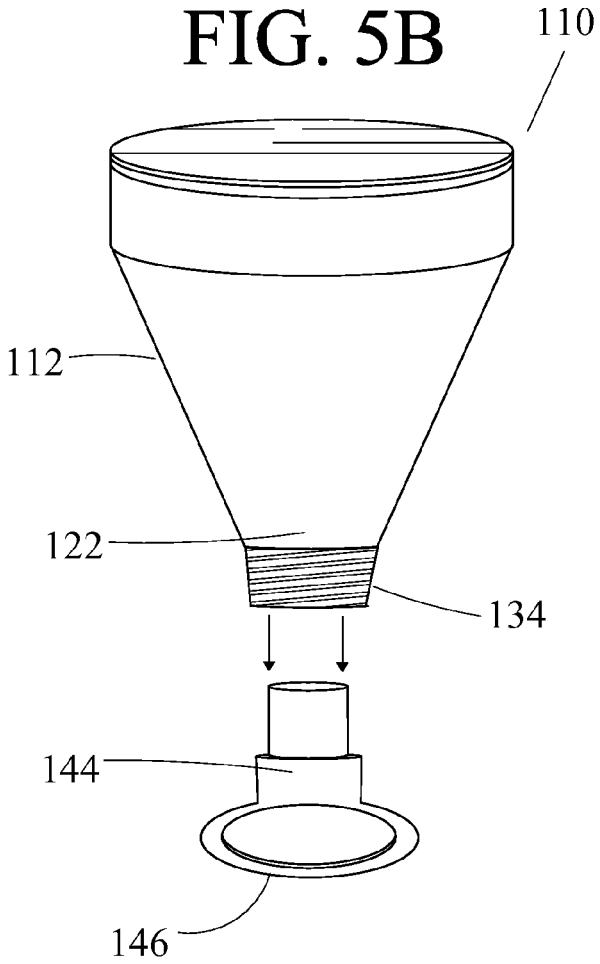

FIGS. 5A and 5B show a Lebanese style hookah bowl embodiment that features a plug seal 144. The plug seal 144 frictionally engages the interior of the particulate outlet so that moisture and air cannot escape the tobacco compartment 112. The plug seal 144 includes a seal handle 146 that allows a user to easily remove the plug seal with the user's fingers. FIG. 5A depicts the plug seal 144 when frictionally engaging the interior of the particulate outlet 122; FIG. 5B depicts the structural arrangement of a preferred plug seal that has been removed from the interior of a hookah bowl 110. The hookah bowl further includes a threaded particulate outlet, which would allow the hookah bowl 110 to mate with a hookah pipe (not shown) having threading.

Figure 6:
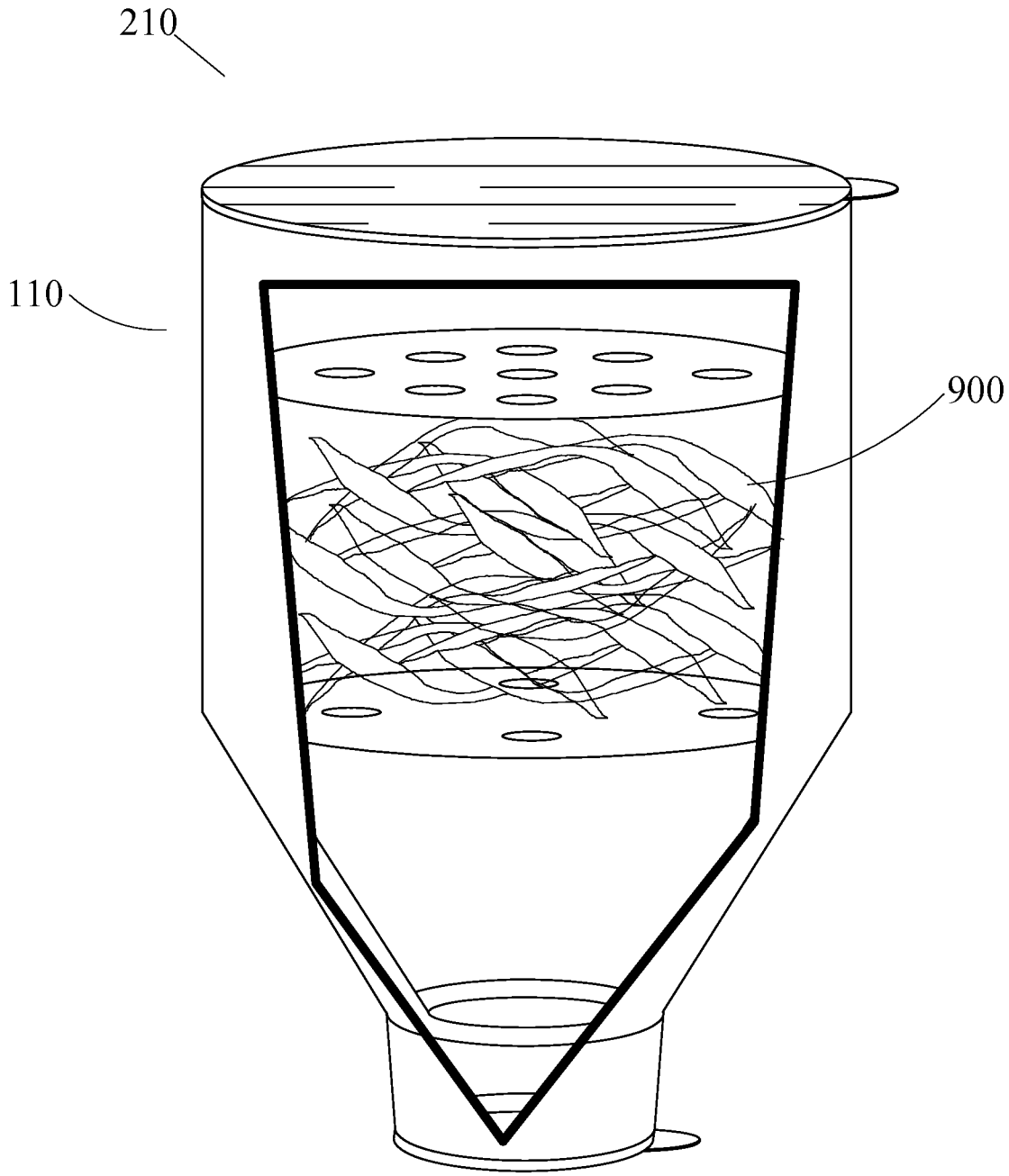
FIG. 6 is a cutaway perspective view of the hookah bowl product.

FIG. 6 illustrates a hookah bowl product 210. The hookah bowl product 210 includes the hookah bowl 110 having a combustible product 900 disposed therein. Though the present invention is configured to work best with massell, any combustible product capable of use with the present invention is sufficient.

Although the disposable hookah bowl has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A disposable hookah bowl comprising:

a tobacco compartment with a rigid, self-supporting, closed sidewall that defines an interior heat inlet and particulate outlet, wherein said sidewall includes an inner wall portion, proximate to said particulate outlet, extending substantially longitudinally within said tobacco compartment and with an orientation configured to form an interference fit upon an exposed end of a hookah stem;

a central, perforated, ignitable product shelf, positioned between said heat inlet and said particulate outlet, statically affixed to and supported by said sidewall;

a central, perforated combustion platform, statically positioned directly above said heat inlet, with a combustion platform perimeter;

a wetted, loose array of tobacco positioned between said product shelf and said combustion platform;

a heat inlet seal, distally positioned proximate to said combustion platform to retain moisture within said tobacco compartment; and a particulate outlet seal, positioned proximate to said particulate outlet, to retain moisture within said tobacco compartment.

2. The disposable hookah bowl of claim 1 wherein said particulate outlet includes threading.

3. The disposable hookah bowl of claim 2 further comprising a threaded outlet cap at least partially obstructing said threaded particulate outlet.

4. The disposable hookah bowl of claim 1 wherein said product shelf is permanently joined to said sidewall.

5. The disposable hookah bowl of claim 4 further comprising a threaded outlet cap configured to at least partially obstruct said tapered particulate outlet.

6. The disposable hookah bowl of claim 5 further wherein said heat inlet seal includes an adhesive for removably affixing said heat inlet seal to said combustion platform.

7. A disposable hookah bowl for direct attachment to a hookah stem, said bowl comprising:

a tobacco compartment with a rigid, self-supporting, closed sidewall that defines an interior heat inlet and particulate outlet, wherein said sidewall includes an inner wall portion, proximate to said particulate outlet, with a tapered orientation extending substantially longitudinally within said tobacco compartment and configured to form an interference fit upon an exposed end of the hookah stem;

a central, perforated, ignitable product shelf, positioned between said heat inlet and said particulate outlet, statically affixed to and supported by said sidewall;

a central, perforated combustion platform, statically positioned directly above said heat inlet, with a combustion platform perimeter;

a wetted, loose array of tobacco positioned between said product shelf and said combustion platform;

a heat inlet seal, distally positioned proximate to said combustion platform to retain moisture within said tobacco compartment; and a particulate outlet seal, positioned proximate to said particulate outlet, to retain moisture within said tobacco compartment.

8. The disposable hookah bowl of claim 7 wherein said heat inlet seal is dimensioned to frictionally engage said heat inlet.

9. The disposable hookah bowl of claim 7 wherein said heat inlet seal includes an adhesive for removably affixing said heat inlet seal to said tobacco compartment.

10. The disposable hookah bowl of claim 9 wherein said product shelf is permanently joined to said sidewall.

11. The disposable hookah bowl of claim 10 wherein both said combustion platform and said tobacco compartment include threading, whereby said threading of said combustion platform and said threading of said tobacco compartment are dimensioned to mate.

12. The disposable hookah bowl of claim 11 further comprising an outlet cap configured to at least partially obstruct said particulate outlet.

13. The disposable hookah bowl of claim 10 further comprising a containment ridge extending above and about said combustion platform perimeter, and wherein said.

14. The disposable hookah bowl of claim 7 wherein said particulate outlet seal includes an adhesive.

15. The disposable hookah bowl of claim 7 wherein said particulate outlet seal frictionally engages said particulate outlet.

16. The disposable hookah bowl of claim 15 wherein said particulate outlet seal further comprises a handle dimensioned to facilitate particulate outlet seal removal.

17. The disposable hookah bowl of claim 15 wherein said particulate outlet seal is an elastic impediment.

18. The disposable hookah bowl of claim 7 wherein said tobacco compartment is fabricated of a substantially translucent material.

19. The disposable hookah bowl of claim 7 wherein said inner wall portion includes a deformable inner wall portion.

20. A disposable hookah bowl for direct attachment to a hookah stem, said bowl comprising:

a tobacco compartment with a rigid, self-supporting, closed sidewall that defines an interior heat inlet and particulate outlet, wherein said sidewall includes an inner wall portion, proximate to said particulate outlet, with a tapered orientation extending substantially longitudinally within said tobacco compartment and configured to form an interference fit upon an exposed end of the hookah stem;

a central, perforated, ignitable product shelf, positioned between said heat inlet and said particulate outlet, statically affixed to and supported by said sidewall;

a central, perforated combustion platform, statically positioned directly above said heat inlet, with a combustion platform perimeter and further comprising a containment ridge extending above and about said combustion platform perimeter;

a wetted, loose array of tobacco positioned between said product shelf and said combustion platform;

a heat inlet seal, distally positioned proximate to said combustion platform to retain moisture within said tobacco compartment; and a particulate outlet seal, positioned proximate to said particulate outlet, to retain moisture within said tobacco compartment.

* * * * *